US009322522B2

(12) United States Patent
Hau et al.

(10) Patent No.: US 9,322,522 B2
(45) Date of Patent: Apr. 26, 2016

(54) SYSTEMS, COMPONENTS, AND METHODS FOR ELECTRONIC CANDLES WITH MOVING FLAMES

(71) Applicant: Wm. B. Coleman Co., Inc., New Orleans, LA (US)

(72) Inventors: Daniel Hau, Hong Kong (CN); Shane Vail, Edina, MN (US); Frank House, Destrehan, LA (US)

(73) Assignee: WM. B. COLEMAN CO., INC., New Orleans, LA (US)

( * ) Notice: Subject to any disclaimer, the term of this patent is extended or adjusted under 35 U.S.C. 154(b) by 131 days.

(21) Appl. No.: 14/159,216

(22) Filed: Jan. 20, 2014

(65) Prior Publication Data

US 2015/0204498 A1 Jul. 23, 2015

Related U.S. Application Data

(63) Continuation-in-part of application No. 13/068,915, filed on May 25, 2011, now Pat. No. 8,733,986.

(51) Int. Cl.

| | |
|---|---|
| ***F21S 10/04*** | (2006.01) |
| ***F21V 23/00*** | (2015.01) |
| *F21Y 101/02* | (2006.01) |

(52) U.S. Cl.

CPC ..... *F21S 10/046* (2013.01); *F21V 23/00* (2013.01); *F21Y 2101/02* (2013.01)

(58) Field of Classification Search

CPC ..... F21S 10/46; F21S 10/046; F21V 23/00

See application file for complete search history.

(56) References Cited

U.S. PATENT DOCUMENTS

2006/0146544 A1* 7/2006 Leung ..... 362/392
2010/0118555 A1 5/2010 Lee (Continued)

FOREIGN PATENT DOCUMENTS

EP 0138786 A1 4/1985
WO 8704506 A1 7/1987

(Continued)

OTHER PUBLICATIONS

European Search Report in European application No. 12790009.0, mailed on Jan. 7, 2015 (8 pages).

*Primary Examiner* — Mary Ellen Bowman
(74) *Attorney, Agent, or Firm* — Buchanan Nipper

(57) ABSTRACT

An electronic candle (10) which simulates a flickering flame is provided. The candle (10) includes a hollow shell (12), a light-emitting element (18) such as an LED and a cap member (20) having the contour of a burning flame covering the light-emitting element (18). An electromagnet is provided to swing the light-emitting element (18). The electromagnet is mounted on a bracket (26) and receives an alternating current. A holding member (40) has a dead weight (52) at one end and the light-emitting element (18) at the other end. A permanent magnet (54) is attached to the bottom of the dead weight (52) such that when an alternating current is applied to the electromagnet it creates a magnetic field for acting on the permanent magnet (54) causing the holding member (40) to swing along an axial direction of the bracket (26). The electromagnet, bracket, dead weight, holding member and permanent magnet are concealed inside the shell (12) with a neck (46) of the holding member (40) to which the light-emitting element is affixed extending out the top end (16) of the shell (12).

15 Claims, 4 Drawing Sheets

(56) References Cited

U.S. PATENT DOCUMENTS

2013/0286642 A1* 10/2013 Patton ..... 362/192
2014/0211458 A1* 7/2014 Lai ..... 362/161

FOREIGN PATENT DOCUMENTS

WO WO 2012162538 A1 * 11/2012
WO WO 2013089401 A1 * 6/2013

* cited by examiner

SYSTEMS, COMPONENTS, AND METHODS FOR ELECTRONIC CANDLES WITH MOVING FLAMES

CROSS-REFERENCE TO RELATED APPLICATIONS

This application is a continuation of my co-pending application Ser. No. 13/068,915 filed on May 25, 2011, entitled, "Systems, Components, and Methods for Electronic Candles with Moving Flames", the full disclosure of which is incorporated by reference herein and priority of which is hereby claimed.

COPYRIGHT NOTICE AND PERMISSION

A portion of this patent document contains material subject to copyright protection. The copyright owner has no objection to the facsimile reproduction by anyone of the patent document or the patent disclosure, as it appears in the Patent and Trademark Office patent files or records, but otherwise reserves all copyrights whatsoever. The following notice applies to this document: Copyright© 2009, Smart Candle LLC.

This document describes one or more specific embodiments of an invention. These embodiments, offered not to limit but only to exemplify and teach the invention, are shown and described in sufficient detail to enable those skilled in the art to implement or practice the invention. Thus, where appropriate to avoid obscuring the invention, the description may omit certain information known to those of skill in the art.

BACKGROUND OF THE INVENTION

This invention relates to an electric simulated candle and more particularly to an electronic candle where the light-emitting element closely simulates the flame of a flickering candle.

Electricity has become the typical power source for lighting. But, there are circumstances where people prefer the warm, romantic, nostalgic atmosphere provided by the light of a wax candle. Wax candles offer a soft light that flickers with the slight air stream. Unfortunately, wax candles use a burning wicker for illumination, and the open flame requires precaution and attention to prevent harm caused by fire. Many electric powered candles are now available as an alternative to wax candles. These candles use a heated wire that is designed to provide an illusion of a burning candle. However, such heated elements do not create an illusion of a real flickering flame and may not be satisfactory for people who seek the appeal of real wax candles. There remains a need in the art for an improved electronic candle that overcomes these and other disadvantages of the prior art.

SUMMARY OF THE INVENTION

Various embodiments described herein concern electronic candles.

One or more embodiments serve one or more of the following objectives:

It is therefore an object of the present invention to provide an electronic candle wherein the light-emitting element closely simulates the flame of a candle.

Another object is to provide an electronic candle which fits into standard household light fixtures.

Another object is to provide an electronic taper candle wherein the light-emitting element can be mechanically swung to create the realistic illusion of a burning wax candle.

An additional object is to provide an electronic candle which is highly decorative and ornamental in appearance but is safe in operation.

A further object is to provide an electronic candle where a first DC electrical current powers the light-emitting element and a separate, alternating current powers the movement of the light-emitting element.

Other objects are to provide an improved device of the character described above, that is easily and economically produced, which is sturdy in construction and which is highly effective in operation.

According to the teachings of one or more embodiments, the electronic candle includes a shell having a hollow interior and a directional axis, a light-emitting element, an induction activating system adapted to swing said light-emitting element along the directional axis and a cap member having the contour of a flame of a burning candle, wherein the cap member covers the light-emitting element. The electronic candle can be used in standard household light fixtures because it includes a standard size screw assembly disposed on one end of the shell from the tip, said screw assembly adapted to be screwed into a standard light bulb socket. When the electronic candle is screwed in a standard light bulb socket, the candle's circuitry means provide an alternating current to the induction activating system and a separate DC current to the light-emitting element.

When the candle is being used, the induction activating system swings or pivots the light-emitting element along a directional axis. In the preferred embodiment, the induction activating system includes a holding element having a first end and a second end wherein the light-emitting element is mounted proximate to said first end. The induction activating system further includes a dead weight coupled to the second end of the holding member, wherein said dead weight balances said holding member. A magnet is disposed under the dead weight. A coil of wire receiving an alternating current creates an alternating magnetic flux to attract and repel the magnet, causing the dead weight coupled to the holding member to swing on the directional axis.

BRIEF DESCRIPTION OF THE DRAWINGS

These and other objects, features and advantages will be apparent from the following detailed description of an illustrative embodiment which is to be read in connection with the accompanying drawings in which.

DETAIL DESCRIPTION OF THE INVENTION

Figure 1:
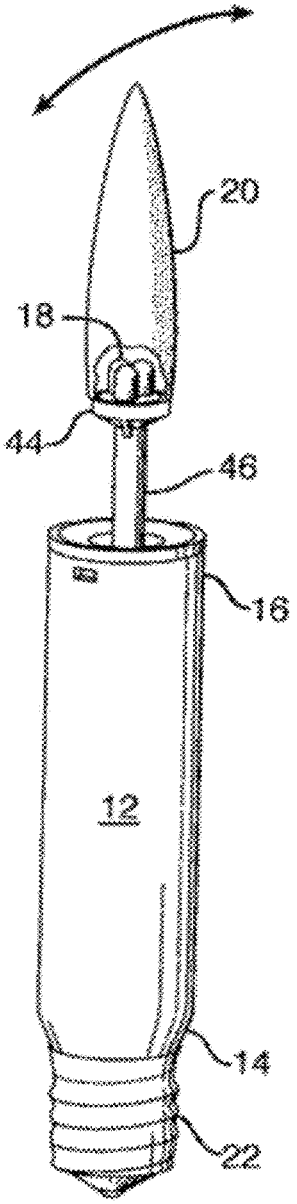
FIG. 1 is a perspective view of the electronic candle of the present invention.
Figure 6:
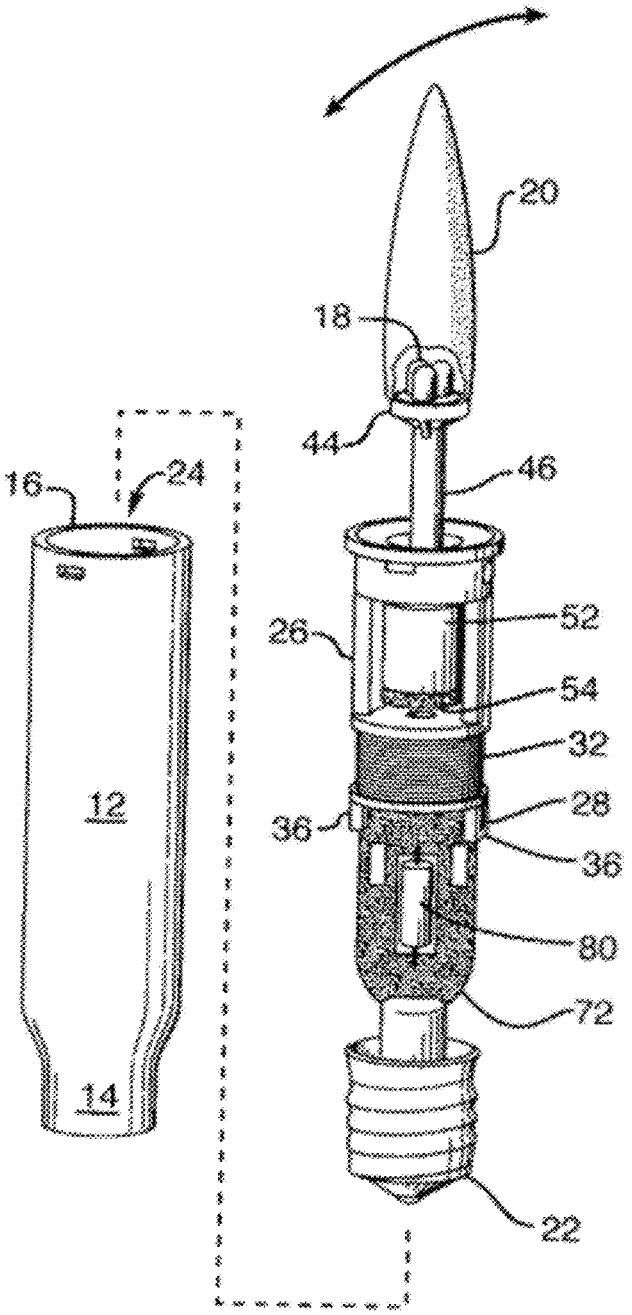
FIG. 6 is a perspective view of the components of the present invention in an insert mode.

Referring to FIGS. 1-6, an electronic candle, indicated generally by numeral 10, includes an elongated candle-like shell 12, a light-emitting element 18 disposed proximate the tip of the shell 12 and a frosted, translucent cap member 20 having the contour of a flame of a burning candle. The cap member 20 covers the light-emitting element 18. In the preferred embodiment, the light-emitting element 18 is a light-emitting diode. The shell 12 has a top end 16 and a bottom end 14. A screw base assembly 22 is disposed on the bottom end 14 of the shell 12. The screw base assembly 22 is of a standard size and is adapted to be screwed into a mating light bulb socket. As will be explained in greater detail below, when in operation, the light-emitting element 18 is made to swing on a pivot assembly along a directional axis of the shell, causing the cap member 20 and light-emitting element 18 to swing back and forth to thus more realistically simulate the flickering of a burning candle flame.

Figure 2:
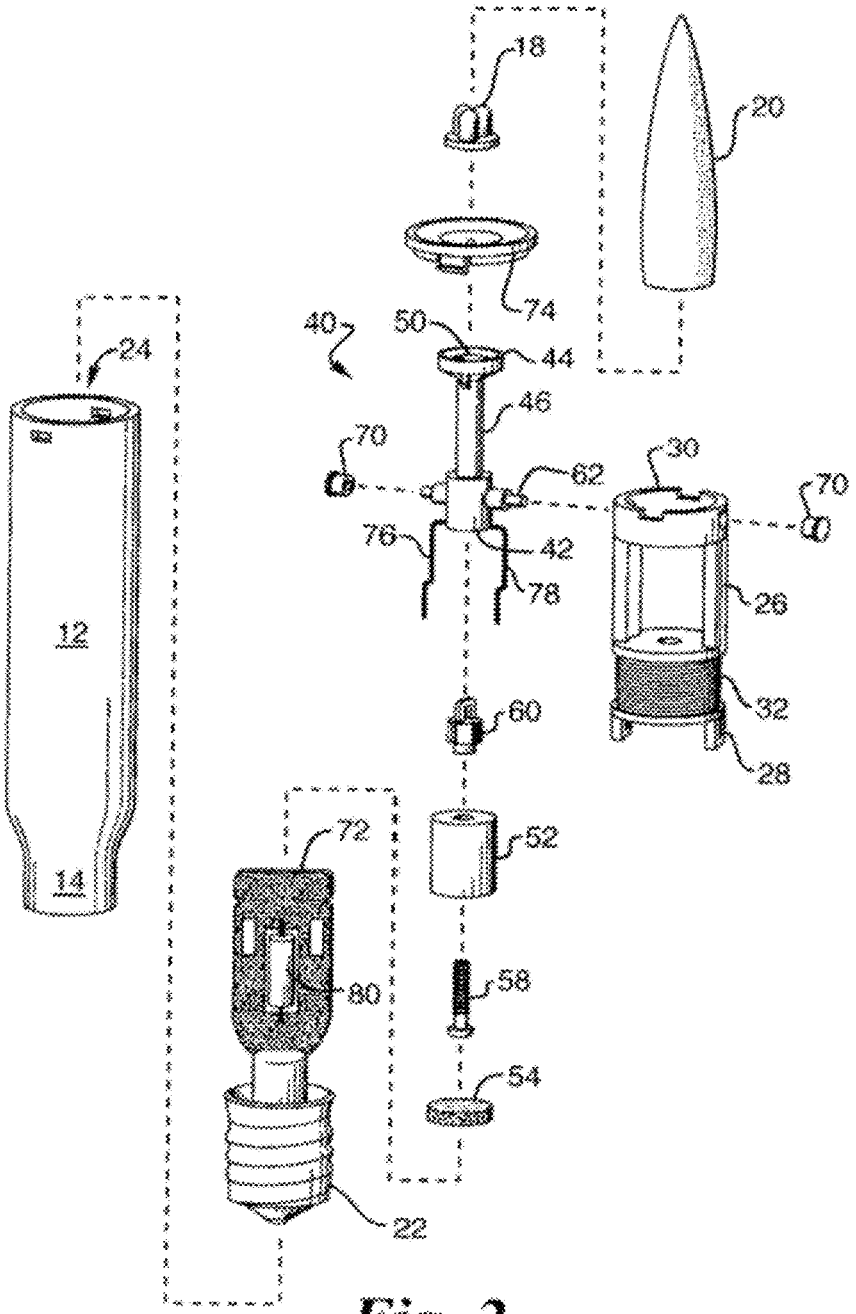
FIG. 2 is an exploded perspective view of the components of the electronic candle of the present invention.

FIG. 2 shows an exploded view of the electronic candle 10. The shell 12 has a hollow interior 24 which houses an induction activating system. The induction activating system includes a molded, plastic bracket member 26 and a pendulum assembly on which the light-emitting element 18 is disposed. The pendulum assembly includes a holding member 40 coupled to a dead weight 52. The holding member 40 is adapted to swing within the bracket 26, causing the light-emitting element 18 and the cap member 20 to also pivot.

Figure 3:
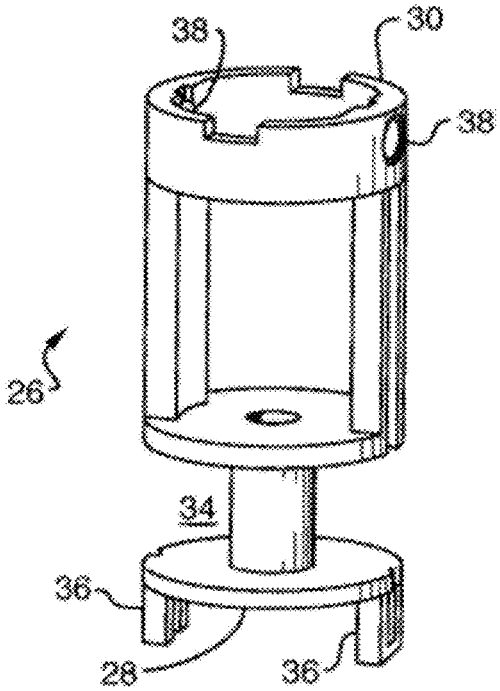
FIG. 3 is a perspective view of the bracket component of the induction activating system of the present invention.
Figure 4:
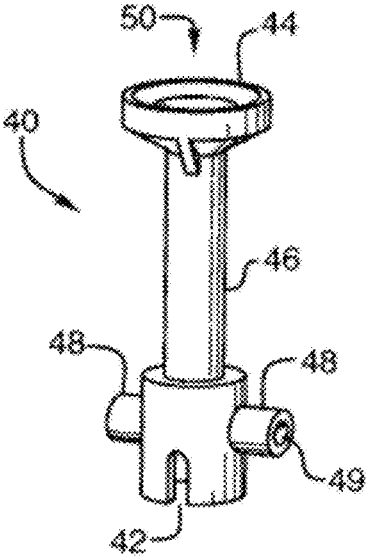
FIG. 4 is a perspective view of the holding member of the induction activating system of the present invention.

As can best be seen in FIG. 3, the bracket member 26 has a first end 28 and a second end 30. Proximate the second end 30 are two opposing circular openings generally designated by numeral 38. The opposing circular openings 38 are sized to accommodate a pivot assembly which will be discussed in greater detail below. The bracket member 26 also includes a spool 34 for receiving a coil of wire 32 (FIG. 2). The spool 34 is disposed below the opposing circular openings 38. Said coil of wire 32 is wrapped about the spool 34. Integrally formed with and extending downwardly from the spool 34 is a circuit support bracket 36.

The holding member 40 includes a first end 42 and a second end 44. A neck portion 46 runs between first end 42 and second end 44 of the holding member 40. Proximate the first end 42 of the holding member 40 are opposing, laterally-protruding swing knobs 48. A bore 49 runs transversely through the opposing knobs 48. The holding member 40 is substantially hollow, however a bowl 50 is formed proximate the second end 44.

The bowl 50 is adapted to hold the light-emitting element 18. A dowel 62 (FIG. 2) is inserted into bore 49 of the knobs 48. The opposing ends of the dowel 62 each have cap members 70 which are sized to fit into the opposing annular openings 38 of the bracket 26. The combination of the dowel 62 with the caps 70 cooperating with the opposed openings 38 form a pivot assembly which allows the holding member 40 to pivot along a directional axis of the bracket 26.

Figure 5:
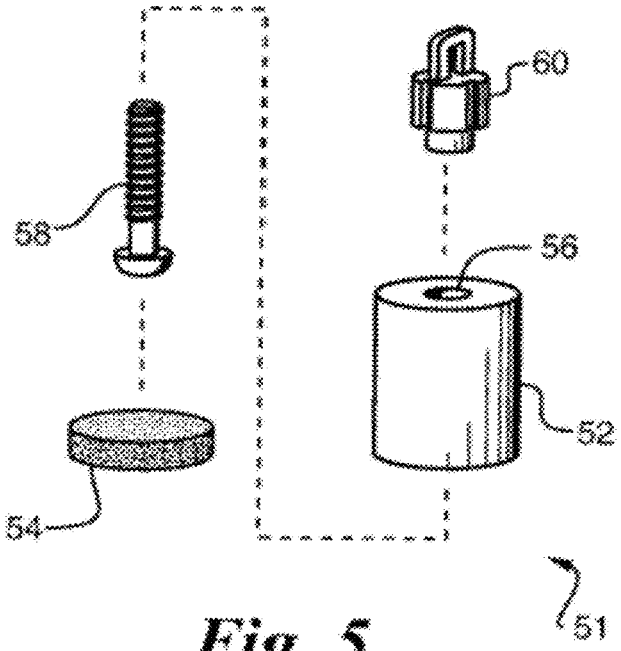
FIG. 5 is a perspective view of the dead weight assembly of the induction activating system of the present invention.
Figure 7:
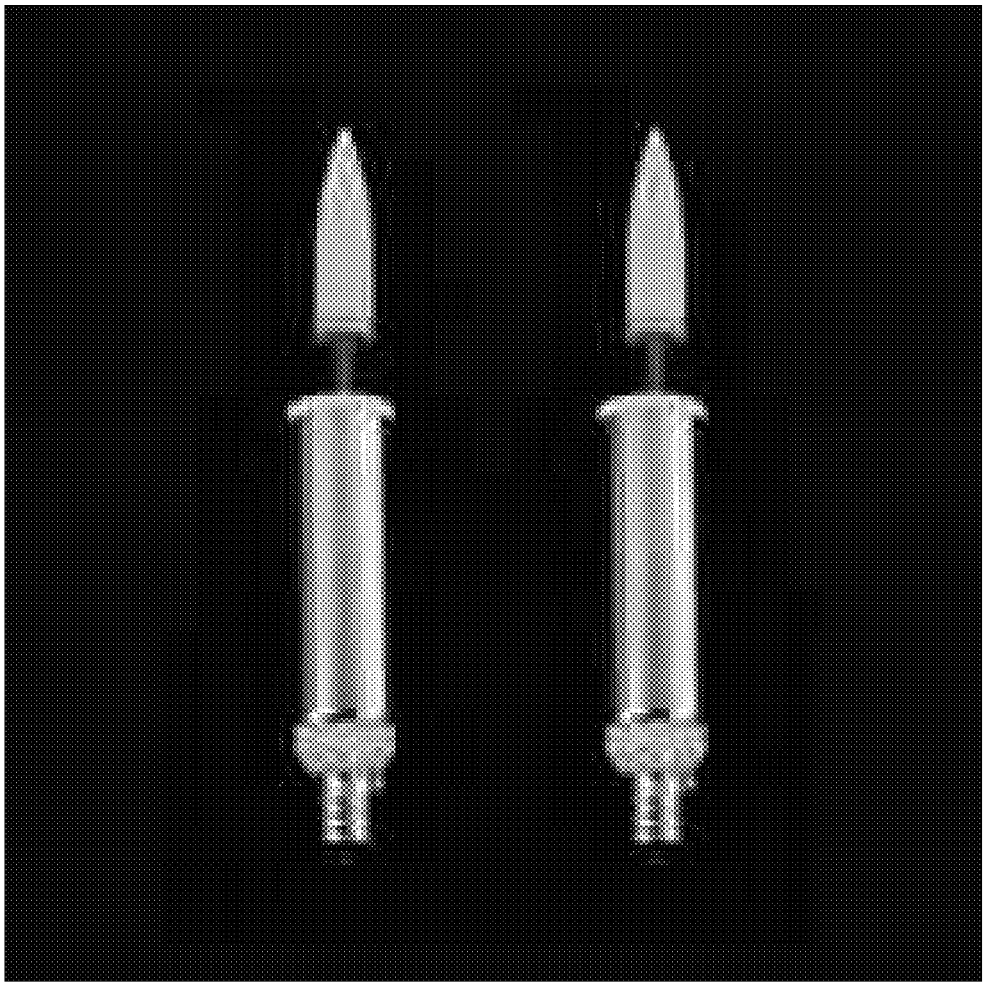
FIG. 7 illustrates an exemplary embodiment of two electronic candles according to the present invention.

FIG. 5 shows the components of the dead weight assembly 51 of the present invention. A cylindrical metallic dead weight 52 is provided that has an axially extending opening 56 extending therethrough. A screw 58 is inserted into the axially extending opening 56 and is threaded into a molded plastic connector 60. The connector 60 cooperates with the first end 42 of the holding member 40 to couple the dead weight 52 to the first end 42 of holding member 40. A disc-shaped permanent magnet 54 is attached to the bottom of the dead weight 52. The dead weight 52 acts as a counter-balance to the swinging of the holding member 40. The poles of the disc-shaped permanent magnet 54 are on opposite side edges of the magnet instead of on its top and bottom surfaces.

A printed circuit board assembly 72 having a bridge rectifier circuit 80 is used to convert an alternating current (AC) input into a direct current (DC) output. In the present invention, the printed circuit board assembly 72 sends an AC current to power the induction activating system and a DC current to power the light-emitting element 18. Wires 76 and 78 run from the printed circuit board assembly 72 to the light-emitting element 18. Wires 76 and 78 run from the printed circuit board assembly 72 up along opposing sides of the bracket 26 into the hollow central bore of the holding member 40 to the light-emitting element 18. The coil 32 wrapped around the spool 34 is charged with an AC current creating an alternating magnetic flux that acts upon the poles of the permanent magnet 54 by induction to cause the dead weight to swing back and forth, thus swinging the holding member 40. In the preferred embodiment, the coil 32 is being activated around 7-9 cycles per second by the printed circuit board assembly 72 to create the swinging action. Because the light-emitting element 18 and the cap 20 are coupled to the second end 44 of the holding member 40, they also oscillate back and forth as the LEDs are made to flicker.

As described above, the electronic candle 10 of the present invention by its low voltage operation and its use of LED lighting provides a safe and convenient electronic candle which also realistically simulates the flickering of a burning candle.

Obviously, many modifications may be made without departing from the basic spirit of the present invention. Accordingly, it will be appreciated by those skilled in the art that within the scope of appended claims, the inventions may be practiced other than as has been specifically described herein.

What is claimed is:

1. An electronic candle comprising:

a generally cylindrical shell having a hollow interior, a top end, a bottom end and a longitudinal axis;

a light-emitting element disposed at the top end of said shell;

a cap member having a contour resembling a flame of a burning candle, wherein the cap member covers the light-emitting element;

an electromagnet assembly disposed within the hollow interior of the shell adjacent the bottom of the shell, said electromagnet assembly being configured to operatively swing said light-emitting element in a pendulum manner transversely to the longitudinal axis of said shell;

a hollow bracket member mounted in the shell, the bracket member being provided with a pair of opposing openings below a top edge of the bracket member; and a holding member mounted in the bracket member, the holding member comprising a pair of opposing swing arms extending outwardly from a lower part of the holding member, each swing arm engageable with a corresponding opening in the bracket member.

2. The electronic candle of claim 1, comprising a screw base assembly disposed on the bottom end of the shell, said screw base assembly being configured to be engaged into a light bulb socket.

3. The electronic candle of claim 2, further comprising an electronic circuitry means coupled to the screw base assembly for delivering electrical current to the light-emitting element and the electromagnet assembly.

4. The electronic candle of claim 1, said bracket member having a first end, a second end, and a spool portion, said bracket member being positioned in the shell below the top end.

5. The electronic candle of claim 4, wherein a coil of wire is wrapped around the spool portion of the bracket member proximate the first end of the bracket member.

6. The electronic candle of claim 5, wherein the holding member has an upper part and wherein the light-emitting element is mounted in the upper part of said holding member.

7. The electronic candle of claim 6, wherein a tubular neck portion extends between the upper part and the lower part of the holding member.

8. The electronic candle of claim 1, wherein the light-emitting element comprises at least one light-emitting diode.

9. An electronic candle comprising:

a generally cylindrical shell having a hollow interior, a top end, a bottom end and a longitudinal axis;

a light-emitting element disposed at the top end of said shell;

a cap member having a contour resembling a flame of a burning candle, wherein the cap member covers the light-emitting element;

a holding member mounted in the shell and supporting the light emitting member, the holding member comprising a pair of opposing hollow co-axial swing arms extending outwardly from a lower part of the holding member;

an electromagnet assembly disposed within the hollow interior of the shell below the holding member, said electromagnet assembly being configured to operatively swing said light-emitting element in a pendulum manner transversely to the longitudinal axis of said shell; and a hollow bracket member mounted in the shell in a surrounding relationship to the holding member, the bracket member being provided with a pair of opposing openings below a top edge of the bracket member, the openings being configured to pivotally engage a corresponding swing arm of the holding member.

10. The electronic candle of claim 9, the bracket member having a first end, a second end, and a spool portion, said bracket member being positioned in the shell below the top end.

11. The electronic candle of claim 10, wherein a coil of wire is wrapped around the spool portion of the bracket member proximate the first end of the bracket member.

12. The electronic candle of claim 9, comprising a screw base assembly disposed on the bottom end of the shell, said screw base assembly being configured to be engaged into a light bulb socket.

13. The electronic candle of claim 12, further comprising an electronic circuitry means coupled to the screw base assembly for delivering electrical current to the light-emitting element and the electromagnet assembly.

14. The electronic candle of claim 9, wherein a bore is formed in the swing arms, and wherein a dowel is inserted into the bore, said dowel extending outwardly from the swing arms.

15. The electronic candle of claim 14, wherein opposing ends of the dowel each have cap a member configured to fit into the opposing openings of the bracket member.

* * * * *